United States Patent [19]

Kjelgaard

[11] 4,433,784

[45] Feb. 28, 1984

[54] ARRANGEMENT ON PACKING CONTAINERS

[75] Inventor: Tom Kjelgaard, Löddeköpinge, Sweden

[73] Assignee: Tetra Pak International AB, Lund, Sweden

[21] Appl. No.: 446,941

[22] Filed: Dec. 6, 1982

[30] Foreign Application Priority Data

Dec. 30, 1981 [SE] Sweden ..... 8107861

[51] Int. Cl.[3] ..... B65D 17/48

[52] U.S. Cl. ..... 206/617; 229/17 R; 206/633

[58] Field of Search ..... 206/617, 616, 633; 229/17 R, 17 G

[56] References Cited

U.S. PATENT DOCUMENTS

| | | | |
|---|---|---|---|
| 2,268,668 | 1/1942 | Moore | 206/617 |
| 2,353,746 | 7/1944 | Moore | 206/617 |
| 3,265,286 | 8/1966 | Inoue | 206/617 |
| 3,497,131 | 2/1970 | Tracy | 206/633 |
| 3,617,311 | 11/1971 | Beltle et al. | 206/616 |
| 3,680,689 | 8/1972 | Grundschober et al. | 206/616 |

FOREIGN PATENT DOCUMENTS

| | | | |
|---|---|---|---|
| 2801404 | 7/1979 | Fed. Rep. of Germany | 206/617 |

*Primary Examiner*—Stephen P. Garbe

*Attorney, Agent, or Firm*—Burns, Doane, Swecker & Mathis

[57] ABSTRACT

The invention relates to an opening arrangement on parallelepipedic packing containers of the type which include a sealing fin extending over the top end wall of the packing container and a longitudinal overlap joint which crosses the sealing fin. In the region of the sealing fin arranged between a crossing point and a tip of a triangular lug, which is connected with the top end wall of the packing container, a strip is provided which includes a central portion of a non-extensible or only slightly extensible, material and outer coverings of thermoplastic. These outer coverings, upon sealing of the fin, will fuse together with an inner plastic covering of the packing material in the fin. The packing container is adapted to be opened by upwardly pulling a part of the strip projecting at the crossing point, so that the central layer of the strip is detached from the outer coverings to form an emptying channel.

6 Claims, 4 Drawing Figures

ARRANGEMENT ON PACKING CONTAINERS

BACKGROUND AND SUMMARY OF THE PRESENT INVENTION

The present invention relates generally to a packing container opening arrangement. More specifically, the present invention relates to an opening arrangement on packing containers of the type which has a sealing fin extending over the top end wall of the packing container, and in which a plastic-covered packing material is joined inside-to-inside in a sealing bond.

A common form of packing container for the distribution of milk, fruit juice and other liquid food products is manufactured from a web of paper, coated on both sides with plastic material, this web being formed into a tube by joining together the longitudinal edges of the web in an overlap joint. Thereafter the tube is filled with the intended contents and is transversely sealed by means of repeated flattening and transverse sealing operations along zones situated at a distance from one another and forming a right angle to the longitudinal direction of the tube. The sealed portions of the tube can then be separated by means of cuts in the sealing zones, whereupon the packing units formed may be given parallelepipedic shape, mostly by compression forming and folding of the packing material along crease lines arranged beforehand. In the folding and forming process double-walled, triangular lugs are produced at four of the packages corners, which can be folded in against, and sealed to, the side and end walls respectively of the packing container.

A packing container of the type mentioned here will be provided with a longitudinal overlap joint, that is to say the joint which constitutes the longitudinal joint of the tube, and transverse finlike sealing joints by which the packing material is joined inside-to-inside. The transverse and longitudinal sealing joints will cross one another on the top and bottom end surfaces of the packing container.

In packing containers of the type mentioned here, mostly one of the triangular lugs is used as an emptying opening, and in general the opening is created by folding the triangular lug up from its position resting against the packing container. The triangular fin is then torn up or cut in some manner so that a channel connecting to the interior of the package is obtained.

Since this tearing up of the said triangular lug along a prepared perforation may involve certain inconveniences, and as a cutting off of the fin presupposes the presence of a tool, it has been suggested instead to solve the problem in such a manner that a tear-wire or a tear-strip is inserted into the sealing fin from the tip of the triangular lug serving as an emptying opening and up to, and past, the crossing point between the longitudinal joint and the transverse joint, so that the tear-wire or tear-strip is accessible from the outside of the package. With the help of such a tear-wire or tear-strip it is thus possible to cut up the sealing joint in the sealing fin, so that an emptying opening is produced. Such a tear-up arrangement is known, for example, from Swedish Pat. No. 402,899.

This form of package opening with the help of a wire or tear-strip, where the wire or tear-strip is to rip through the seal produced in order to form an emptying opening, has not proved to function fully satisfactorily. Primarily, this is because the tear-tape or tear-strip often fails to cut straight through the sealing joint, but instead cuts between the paper material and the plastic covering of either of the material layers. This means that the raw fiber surface of the paper material is exposed, so that, on pouring out the contents, the latter come into contact with the raw paper surface which then rapidly becomes soaked and loses its rigidity. Among other inconveniences, it may be mentioned that relatively great forces are required for the ripping up of the sealing joint. Also, it happens not infrequently that the tear-wire, instead of tearing within the actual joint, rips apart the paper layer on one side of the sealing fin, that is to say it "runs off the rails".

The disadvantages mentioned above can be avoided with an arrangement in accordance with the present invention, in which, at least along a part of the sealing fin, the packing material layers facing towards each other include between them a strip, inserted in the sealing fin. The strip includes a central layer of a non-extensible, or only slightly extensible, material which is provided on both sides with covering layers of the same, or similar plastic material as that present on the inside of the packing material. The covering layers on the strip are sealed by heat-sealing to the inner plastic layer of the packing material with good adhesive strength, while the adhesive force between the central layer of the strip and the covering layers on the strip is inferior to the adhesive force between the covering layer of the strip and the inner layer of the package material.

BRIEF DESCRIPTION OF THE DRAWINGS

In the following the invention wll be described with reference to the enclosed schematic drawings, wherein.

DETAILED DESCRIPTION OF THE PREFERRED EMBODIMENT

Figure 1:
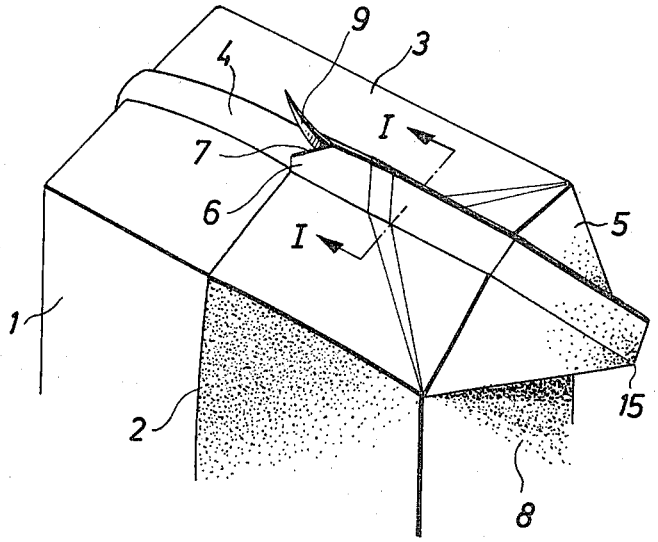
FIG. 1 is a perspective view of an opening arrangement portion of a packing container which has not yet been ripped open.

The packing container 1 shown in FIG. 1 is of the type which has been described earlier and which thus has been manufactured from a web which is folded to a tube and which has subsequently been filled with contents and transversely sealed.

The packing container includes a longitudinal sealing joint 2 of the overlap type and a sealing fin 4 which extends along the top end wall 3 of the packing container 1. As can be seen, the packing container has a triangular, double-walled lug 5 which is intended to function as an emptying opening. In the figure the triangular lug 5 has been pried up and partially raised from the side wall 8 of the package against which it is normally sealed.

In a crossing point 6 between the longitudinal overlap joint 2 and the transverse sealing fin 4 the edge of the overlapping material is cut obliquely along the area 7 and a part of the strip 10 inserted in the fin 4 projects at the crossing point 6.

Figure 3:
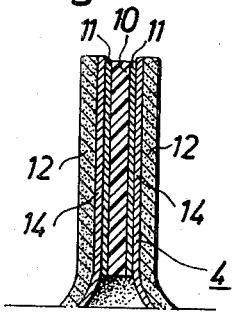
FIGS. 3 and 4 are cross-sectional views of sealing fins of the packing containers along section lines I—I and II—II of FIGS. 1 and 2 respectively.

FIG. 3 shows a cross-section of the sealing fin 4 taken along section line I—I of FIG. 1. As is evident from the figure, the sealing fin within the region includes two layers 12 of the packing material from which the packing container 1 is manufactured facing towards each other. Each layer of packing material 12 is provided with an inner covering 14 of thermoplastic material, usually polyethylene, and in the region of the sealing fin 4, where no strip 10 is inserted, the packing material layers 12 are joined directly to one another by surface fusion of the plastic layers 14, this surface fusion being achieved with the help of pressure with simultaneous application of heat.

In the region of the sealing fin 4 where the strip 10 is inserted, that is to say the region from the crossing point 6 between the longitudinal joint 2 and the transverse joint 4 to the tip 15 of the triangular lug 5, the inner layers 14 of the packing material 12 are not directly in contact with one another and sealed to one another. Instead the plastic coverings 14 are sealed to the outer coverings 11 of the strip 10 which outer coverings are made of plastic material, preferably polyethylene.

On heating the polyethylene layers 11 and 14 facing towards one another will be fused together so as to form a very good sealing joint, while the adhesive forces between the central layer of the strip 10 of non-extensible material and the inner coverings 11 of polyethylene are not as strong as the adhesive forces between the fused polyethylene layers 11 and 14.

As mentioned before, the strip 10 is manufactured from a non-extensible, or only slightly extensible, plastic material, e.g. oriented polyester, nylon, metal foil etc., the two sides of the strip being covered with a relatively easily sealable plastic material 11, preferably polyethylene. Since the central layer of the strip 10 and the outer coverings are not of the same, or even wholly compatible, material, the adhesive forces will not be particularly great. However, through the choice of a suitable sealing temperature and possibly pretreatment, such as priming, of the strip material, it is possible in principle to obtain the adhesive strength which is desired. The demand made on the adhesive strength is that the layers 11 must not delaminate from the central layer of the strip 10 when the package is subjected to the stresses which arise during normal transport and handling, whereas it should be readily possible, at the same time, to "draw away" the central layer of the strip 10 from the sealing fin 4 by pulling at the projecting part 9 of the strip when the package is to be opened.

It has been found that it is definitely possible to achieve a degree of adhesion which is adapted so that the packing container in unopened position does not spontaneously open, but that it is readily feasible to rip away the central layer of the strip 10 and consequently delaminate the central layer from the outer coverings 11.

The part 9 of the strip 10 which projects outside the crossing point 6 and is accessible from the outside of the package, preferably should not have any outer covering 11 of plastic material, since such a covering would make the tearing up of the strip more difficult. It is conceivable that the covering 11 of the strip 10 could be wholly eliminated by not being present along the projecting portion 9 of the strip 10, or else the effect of the plastic coverings 11 could be eliminated through cuts or notches in the plastic layers 11 in the region of the crossing point 6. In this way the plastic coverings 11 along the accessible portion 9, owing to the presence of the cutting lines, would not be connected to the covering layers 11 along the parts of the strip which are included in the sealing fin 4.

Figure 2:
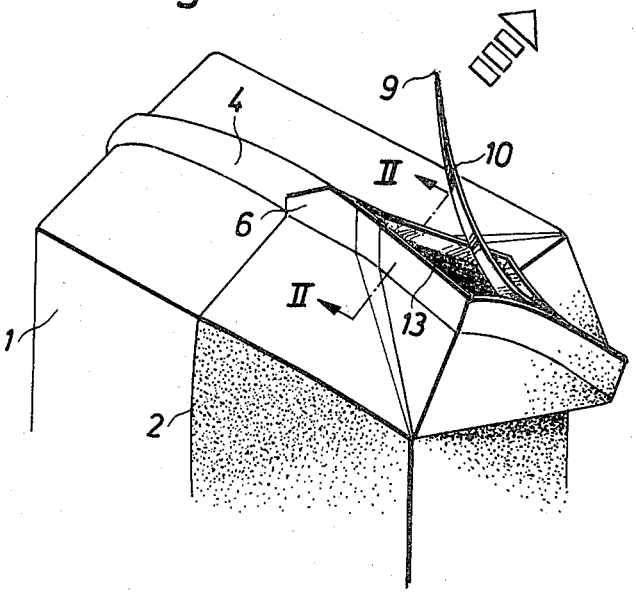
FIG. 2 is a perspective view of the packing continer of FIG. 1 during the opening process.
Figure 4:
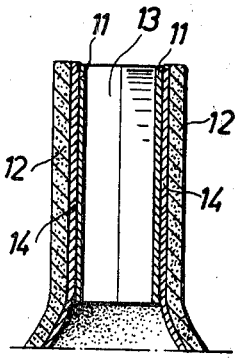

FIG. 2 illustrates how the opening takes place. In operation, the projecting part of the strip 10 is pulled upwards, as a result of which the outer covering 11 remains on the inside of the sealing fin 4, which is shown in FIG. 4, while the central layer of the strip 10 is removed from the opening zone. In FIG. 4, which constitutes a section II—II of FIG. 2, it is evident how an emptying channel 13 is formed when the strip 10 has been torn off without fiber being torn from the paper portion of the packing material 12. Instead, an additional plastic layer 11 is obtained around the emptying channel 13.

It has been found that with the help of the arrangement in accordance with the present invention a readily openable package can be obtained with the help of a tearing strip arranged in the sealing fin, without the disadvantages which were attached to previous embodiments of opening arrangements having a tear-wire or a tear-strip.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. An opening arrangement for a packing container of the type having a sealing fin extending over a top end wall, the sealing fin including two adjoining sheets of a packing material covered with a plastic covering on at least their facing surfaces, the opening arrangement comprising:

a strip inserted between the adjoining sheets of the sealing fin along at least a portion of the sealing fin, said strip including a central layer and two outer layers of a plastic material similar to the plastic covering on each sheet of the packing material, said outer layers of said strip being sealed to the plastic covering of each sheet, an adhesive force between said central layer of said strip and said outer layers of said strip being weaker than an adhesive force between said outer layers of said strip and the plastic covering of each sheet to enable said central layer to be pulled away to open the packing container.

2. The opening arrangement in accordance with claim 1, wherein the central layer of the strip is a relatively non-extensible material constituted of one of the group of nylon and polyester and the outer plastic layers are constituted of polyethylene.

3. The opening arrangement in accordance with claim 1, wherein the packing container includes a longitudinal overlap joint extending over one side wall of the packing container and up to and crossing the sealing fin provided on the top end wall of the packing container, and the sealing fin extends over, and up to the tip of, a double-walled triangular lug which is located on one corner of the packing container and whose inside communicates with the inside of the packing container, said strip being adapted to extend in the sealing fin from the tip of said triangular lug and past a crossing point between said longitudinal overlap joint and the fin, a portion of the strip being accessible from the outside of the packing container.

4. The opening arrangement in accordance with claim 3, wherein the portion of the strip which projects from the sealing fin through the longitudinal joint includes only said central layer with said outer plastic layers not being provided thereon.

5. An opening arrangement for packing containers, comprising:

a sealing fin extending over a top end wall portion of a packing container, said sealing fin including two adjoining sheets of a packing material, each sheet of said packing material having a fibrous base layer and a plastic layer, said plastic layer covering at least the inwardly facing surfaces of said base layers; and an opening strip inserted between said adjoining sheets of said packing material along at least a portion of said sealing fin, said strip including a central layer of a relatively non-extensible material and two outer layers of a plastic material similar to said plastic layer on said packing material, each of said plastic outer layers of said opening strip being sealed to a respective plastic layer of one of said sheets, an adhesive force between said central layer of said strip and said outer layers of said strip being weaker than an adhesive force between said outer layers of said strip and a respective one of said plastic layers of one of said sheets, whereby said central layer of said strip may be pulled away from said packing container to open said packing container, while each of said outer layers of said strip remain attached to a respective one of said plastic layers of one of said sheets.

6. The opening arrangement of claim 5 wherein a portion of said opening strip extends out of said sealing fin to provide a pulling tab, said extending portion of said opening strip including only said central layer with said two outer plastic layers not being provided thereon.

* * * * *